US006293628B1

(12) United States Patent
Schwoebel et al.

(10) Patent No.: US 6,293,628 B1
(45) **Date of Patent: *Sep. 25, 2001**

(54) HYDRAULIC SCROLL AUGER MINING SYSTEM AND METHOD OF USING THE SAME

(75) Inventors: Jeffrey J. Schwoebel, Free Union; Donald B. Sult, Charlottesville, both of VA (US); William J. Peters, Winfield, WV (US)

(73) Assignee: Amvest Systems Inc., Charlottesville, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/281,362

(22) Filed: Mar. 30, 1999

Related U.S. Application Data

(63) Continuation-in-part of application No. 09/191,183, filed on Nov. 13, 1998, which is a continuation-in-part of application No. 08/745,459, filed on Nov. 12, 1996, now Pat. No. 5,879,057.

(60) Provisional application No. 60/079,835, filed on Mar. 30, 1998, provisional application No. 60/079,941, filed on Mar. 30, 1998, provisional application No. 60/093,357, filed on Jul. 20, 1998, and provisional application No. 60/092,881, filed on Jul. 15, 1998.

(51) Int. Cl.[7] ..... E21C 35/23; E21C 35/187

(52) U.S. Cl. ..... 299/17; 299/56

(58) Field of Search ..... 299/56, 55, 81.2, 299/68, 17

(56) References Cited

U.S. PATENT DOCUMENTS

| | | | | |
|---|---|---|---|---|
| 2,616,677 | | 11/1952 | Compton | 299/56 |
| 2,940,740 | | 6/1960 | Adams | 299/57 |
| 2,951,693 | | 9/1960 | Carothers | 299/55 |
| 3,278,236 | | 10/1966 | Adams et al. | 299/55 |
| 3,281,187 | | 10/1966 | Adams et al. | 299/55 |
| 3,663,062 | | 5/1972 | Young et al. | 299/57 |
| 3,830,545 | * | 8/1974 | Sugden | 299/33 |
| 3,912,025 | | 10/1975 | Deeter et al. | 175/91 |
| 3,949,815 | * | 4/1976 | Bryant, Jr. et al. | 173/189 |
| 3,980,342 | | 9/1976 | Dunham | 299/56 |
| 4,074,920 | | 2/1978 | Joyce | 299/18 |
| 4,159,149 | | 6/1979 | Castanoli | 299/80.1 |
| 4,332,420 | * | 6/1982 | Coski | 299/31 |
| 4,390,212 | | 6/1983 | Nitzberg | 299/57 |
| 4,441,761 | | 4/1984 | Fields et al. | 299/64 |
| 4,444,278 | * | 4/1984 | Rocchetti | 175/108 |
| 4,889,392 | | 12/1989 | Justice et al. | 299/18 |
| 5,087,101 | | 2/1992 | Justice et al. | 299/18 |
| 5,114,213 | * | 5/1992 | Kornecki et al. | 299/81.2 |
| 5,879,057 | * | 3/1999 | Schwoebel et al. | 299/17 |

FOREIGN PATENT DOCUMENTS

2193987 * 2/1988 (GB) .

* cited by examiner

*Primary Examiner*—David Bagnell
*Assistant Examiner*—Sunil Singh
(74) *Attorney, Agent, or Firm*—Jenkens & Gilchrist, P.C.

(57) ABSTRACT

A preferred cutting head includes a first body having a manifold for containing high pressure fluid and an axis of rotation generally parallel to the borehole, a first plurality of mechanical bits disposed on the first body, a first plurality of nozzles disposed around the axis of rotation for spraying the high pressure fluid, and a plurality of tubes fluidly coupling the manifold and the first plurality of nozzles. On supplying high pressure fluid to the manifold and rotating the cutting head about the axis of rotation, the nozzles create a generally circular, overlapping pattern of high pressure fluid in front of the cutting head, the pattern of high pressure fluid being directed to cut the borehole independently of the mechanical bits.

48 Claims, 5 Drawing Sheets

HYDRAULIC SCROLL AUGER MINING SYSTEM AND METHOD OF USING THE SAME

This application is a continuation-in-part of commonly owned U.S. application Ser. No. 09/191,183, filed Nov. 13, 1998 and now pending, which is a continuation-in-part of U.S. application Ser. No. 08/745,459, filed Nov. 12, 1996 and now issued as U.S. Pat. No. 5,879,057, both of which are incorporated in their entirety herein by specific reference thereto. Additionally, this application claims the benefit of U.S. Provisional Application No. 60/079,835, filed Mar. 30, 1998; U.S. Provisional Application No. 60/079,941, filed Mar. 30, 1998; U.S. Provisional Application No. 60/093,357, filed Jul. 20, 1998; and U.S. Provisional Application No. 60/092,881, filed Jul. 15, 1998, all of which are incorporated in their entirety herein by specific reference thereto.

FIELD OF THE INVENTION

The present invention generally pertains to drilling and mining processes and, more particularly, but not by way of limitation, to a mining system particularly adapted for the recovery of coal from relatively thin, generally horizontal coal seams.

HISTORY OF THE RELATED ART

The recovery of coal from coal seams has been the subject of technical development for centuries. Among the more conventional mining techniques, hydraulic mining systems have found certain industry acceptance. Hydraulic mining typically utilizes high pressure water jets to disintegrate material existing in strata or seams generally disposed overhead of the water jets. The dislodged material is permitted to fall to the floor of the mining area and is transported to the mining surface via gravity and/or water in a flume or slurry pipeline. Along these lines, certain developments in Russia included a series of hydro monitors capable of extracting a strip of coal 3 feet wide and 30 to 40 feet in depth within a matter of minutes. The units were designed to be conveyed on a track to the advancing coal face for extracting the coal. The coal would flow downwardly and be transported to the surface via a flume. Similar techniques to this have found commercial acceptance in China, Canada, and Poland, but with only limited attempts in the United States.

Although hydraulic mining techniques have proven effective in the cutting of a relatively large seam of coal, conventional hydraulic cutting systems do not cut as effectively in narrow seams or when rock strata are present within the coal seams.

Another conventional technique for extracting minerals from subterranean deposits is a scroll auger. Scroll augers have been used to mine relatively thin, generally horizontal seams of coal. Conventional auger mining machines typically include a cylindrical auger having helical vanes used to transport cut coal away from a cutting head located on the front or in by end of the auger. The cutting head typically comprises a mechanical bit centered on the front of the auger. The auger and cutting head are rotated, and advanced into a coal seam, using a conventional auger drill unit that is coupled to the rear or outby end of the auger. As the cutting head is advanced into the borehole, additional auger segments may be added to achieve greater depth.

However, scroll augers are difficult to steer, and therefore such augers tend to migrate into adjacent boreholes or out of the coal seam altogether. In addition, as the cutting head advances away from the drilling unit, more and more power is required to put weight on the cutting head and to turn the auger sections. For both of these reasons, the length of the borehole, and thus the length of a particular section of the coal seam actually mined, are typically limited to distances of less than three hundred feet. Therefore, numerous, expensive access tunnels may be required to mine a given seam of coal.

A need exists in the mining industry for a reliable mining system that addresses the limitations of the above-described conventional mining systems. Specifically, a need exists for auger mining techniques to allow deeper penetration, higher rates of penetration, and improved productivity. This need is even greater with regard to economically mining relatively thin, generally horizontal coal seams.

BRIEF DESCRIPTION OF THE DRAWINGS

For a more complete understanding of the present invention, and for further objects and advantages thereof, reference is made to the following description taken in conjunction with the accompanying drawings in which.

DETAILED DESCRIPTION OF THE PREFERRED EMBODIMENT

The preferred embodiment of the present invention and its advantages are best understood by referring to FIGS. 1–7 of the drawings, like numerals being used for like and corresponding parts of the various drawings.

Figure 1:
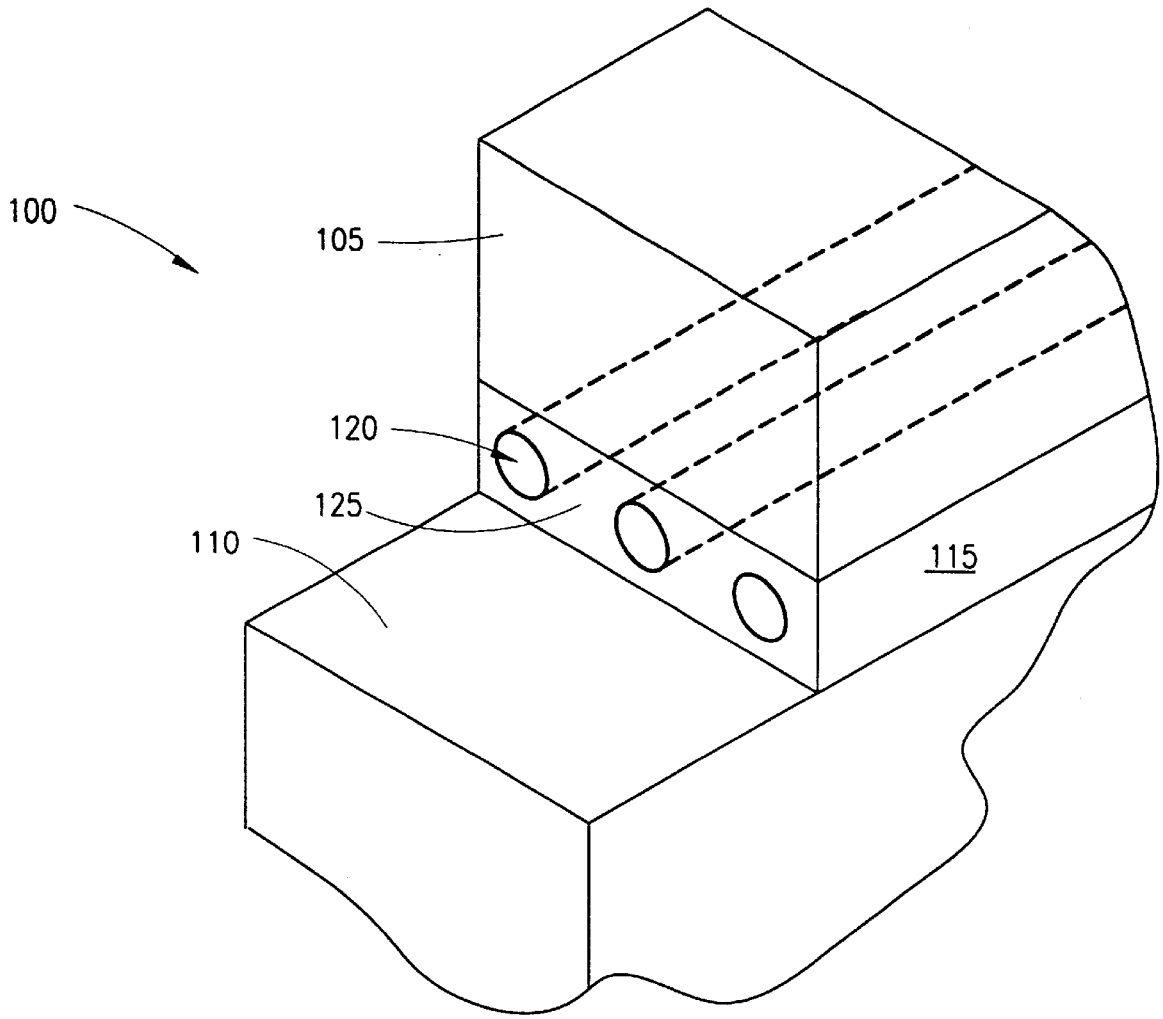
FIG. 1 is a front, perspective view of a defined area for the horizontal mining operations of the present invention.

Referring now to FIG. 1, there is shown a front, perspective view of a defined area 100 for the horizontal mining operations of the present invention. Area 100 may comprise a mineral deposit of relatively thin proportions, perhaps on the order of 1 to 8 feet in thickness. Minerals such as coal in seams only 1 to 8 feet thick can be difficult to mine in an economical fashion with conventional technology. For that reason, the present invention affords a marked improvement over the prior art.

As shown in FIG. 1, defined area 100 comprises a region that is preferably only a portion of a larger mineral deposit for which mining is desired. An outcrop of a coal seam provides access from ground level to the subterranean deposit.

By way of example, such an exposed mineral outcrop may be visible in the highwall surface 105 left behind by a conventional strip mining operation. A bench 110 or ledge is also typically located between the exposed highwall surfaces 105. A plurality of boreholes 120 may be formed transversely through the mineral excavation region 115 by the mining system 200 of the present invention, a preferred embodiment of which is shown in FIGS. 2–7. Each of boreholes 120 are preferably generally circular in shape and have a diameter equal to the approximate thickness of the excavation region 115. Boreholes 120 are formed in a generally parallel relationship to one another, and a web of coal 125 is located between adjacent bore holes. Webs 125 preferably have a generally "hour glass" shape, and each web 125 preferably has a width, measured at its minimum dimension along its centerline, of approximately 0.5 to two (2) feet.

Referring now to FIGS. 2 through 5 in combination, a preferred embodiment of mining system 200 is shown in greater detail. Mining system 200 includes an auger body 202 having a hollow inby or front end 204, a cutting head 206 disposed in hollow front end 204, and an auger drill unit 208.

Figure 2:
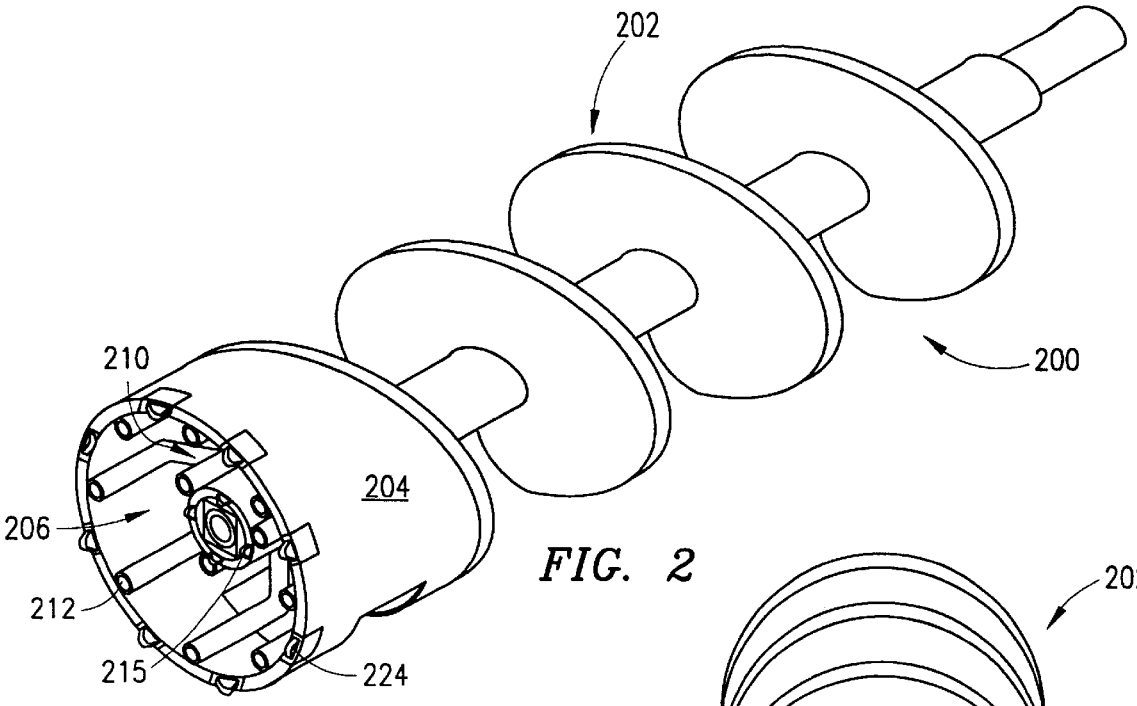
FIG. 2 is a front, perspective view of a preferred embodiment of a mining system of the present invention.
Figure 2A:
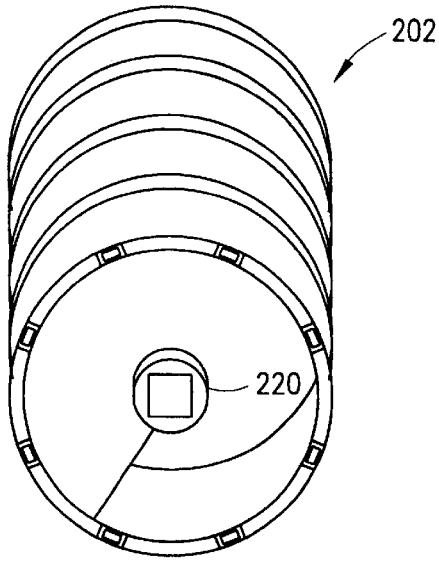
FIG. 2*a* is a front end, perspective view of the cutting head and auger body of FIG. 2.
Figure 3:
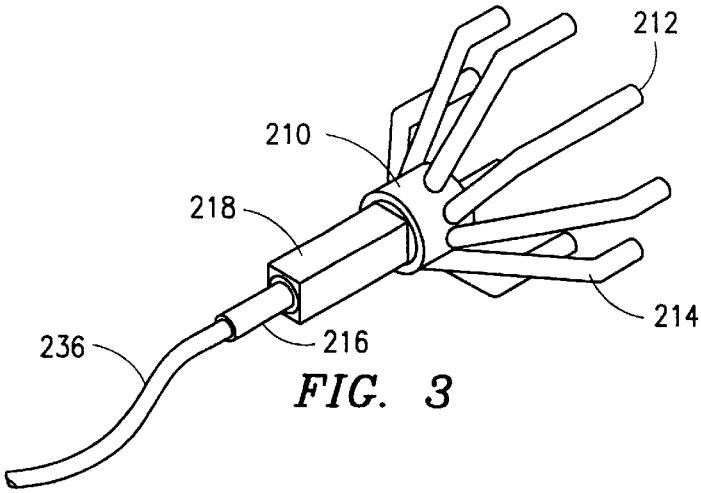
FIG. 3 is an exploded, perspective view of the cutting head and auger body of FIG. 2.
Figure 2B:
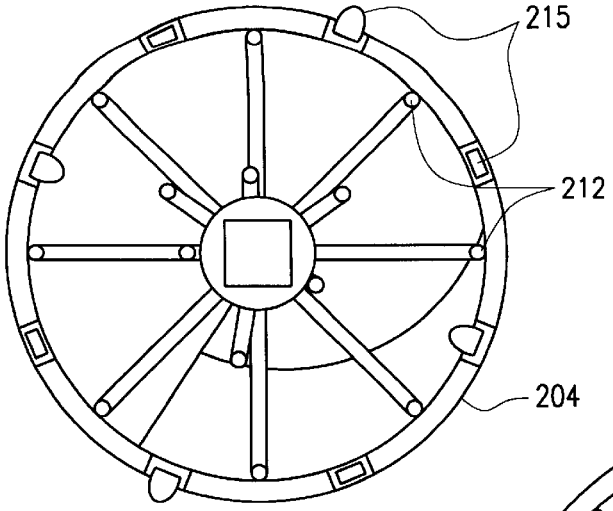
FIGS. 2*b–d* is a front end, elevational view of an alternate embodiment of the cutting head of FIG. 2 and FIG. 2*a*.
Figure 2C:
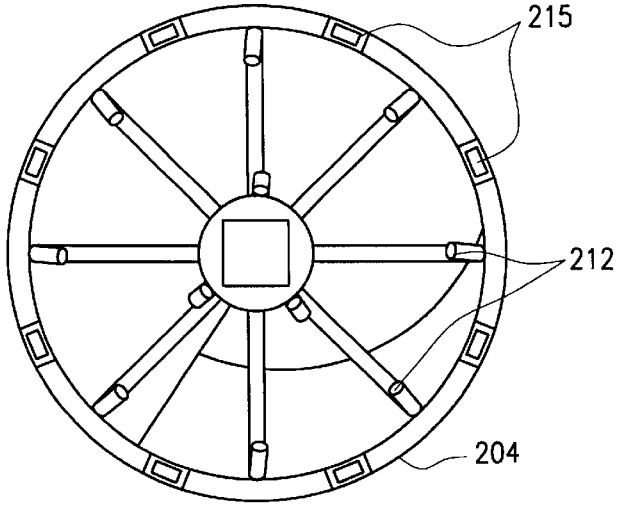
Figure 2D:
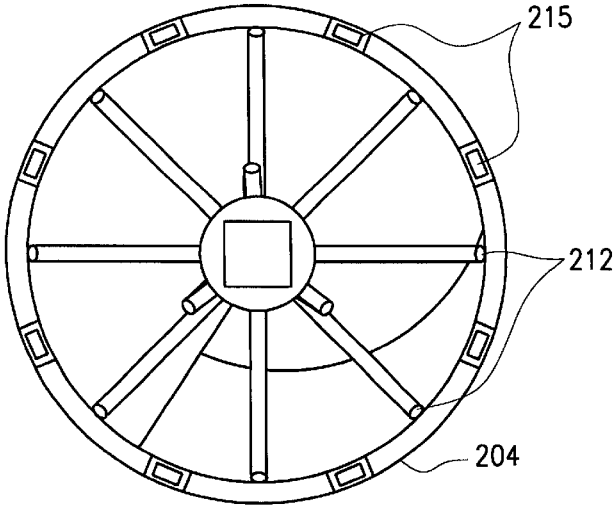

As shown best in FIGS. 2 and 3, cutting head 206 includes a manifold or nozzle head 210 that distributes a high pressure fluid, such as water, to a plurality of water jet nozzles 212 arranged in a generally circular pattern around the nozzle head 210. Hollow tubing 214 provides fluid communication between nozzle head 210 and nozzles 212. Cutting head 206 also includes a plurality of conventional mechanical bits 215 located in front of nozzle head 210. At least one of the mechanical bits 215 is angled inward relative to the axis of rotation and at least one of the mechanical bits 215 is angled outward relative to the axis or rotation. Further, mechanical bit 215 may be arranged wherein at least one of mechanical bits 215 are angled, relative to the axis of rotation of auger body 202 in an angled inward, angled outward repeating pattern around the periphery of the first body. A high pressure water swivel 216 is connected to a rear end 218 of nozzle head 210.

Figure 4:
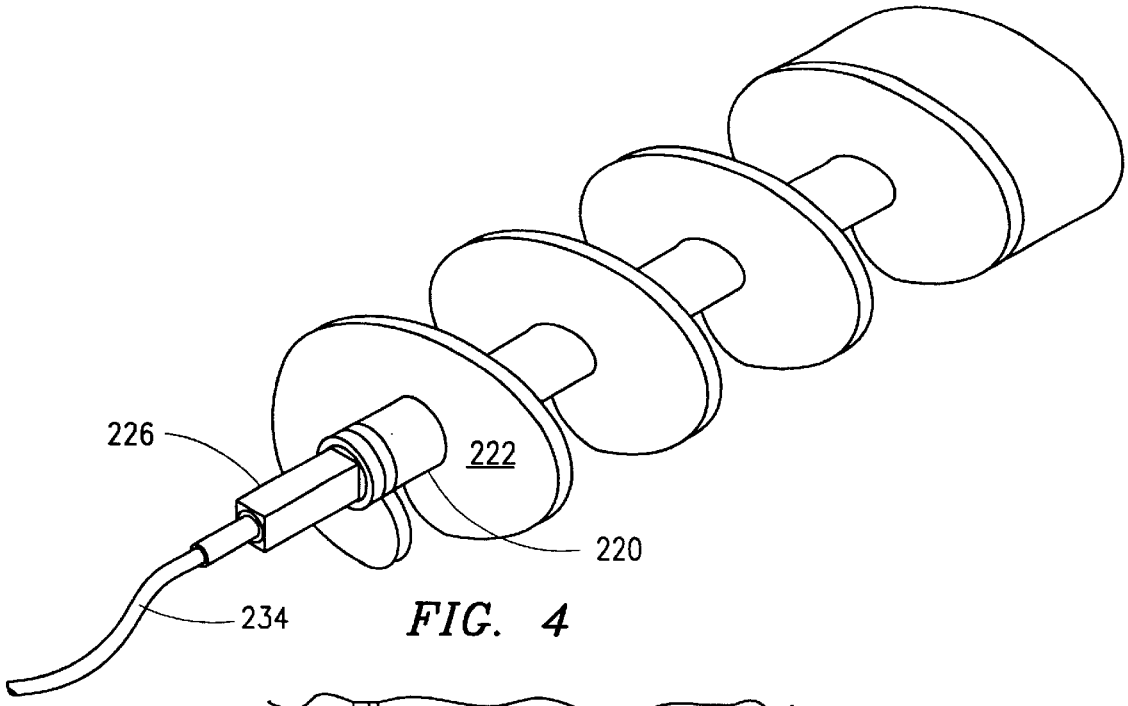
FIG. 4 is a rear, perspective view of the mining system of FIG. 2.

As shown best in FIGS. 2 through 4, auger body 202 includes a hollow shaft 220 and a plurality of generally helical screw turns 222 coupled to, and extending from, shaft 220. Rear end 218 of nozzle head 210 is removably received within the front end of shaft 220 to secure cutting head 206 within hollow front end 204 of auger body 202. Preferably, nozzles 212 are arranged so as to just fit within the inner diameter of front end 204, and each of tubing 214 is coupled to nozzle head 210 by welding or other conventional means. Nozzles 212 may be arranged wherein at least one of the nozzles 212 is disposed proximate the nozzle head 210, at least another one of the nozzles 212 is disposed between the nozzle head 210 and a second body and at least a third one of the nozzles 212 is disposed proximate the second body. Additionally, nozzles 212 may be arranged wherein at least one of nozzles 212 is angled inward relative to the axis or rotation of auger body 202. Further, at least one of nozzles 212 may be arranged wherein a t least one of nozzles 212 is angled inward relative to the axis of rotation at an angle between about zero and about thirty degrees. Nozzles 212 may also be arranged wherein at least another of nozzles 212 are angled outward relative to the axis of rotation of auger body 202. Additionally, nozzles 212 may be arranged wherein at least one additional nozzle 212 is angled outward relative to the axis of rotation of auger body 202 at an angle between about zero and about thirty degrees. A plurality of conventional mechanical bits 224 are preferably attached by bit blocks to the circumference of hollow front end 204, with at least one bit 224 disposed between each of nozzles 212. Conventional mechanical bits 224 may be arranged wherein at least one of the mechanical bits 224 is a angled inward relative to the axis of rotation of auger body 212. Additionally, at least one of said mechanical bits 224 is angled outward relative to the axis of rotation of auger body 212. Further, the mechanical bits 224 may be arranged wherein bits 224 are angled, relative to the axis of rotation of auger body 212, in a straight ahead orientation, angled inward, and angled outward in a repeating pattern around a periphery of a second body on the front end 204 of mining system 200. Shaft 220 terminates in outby or rear end 226.

Figure 5:
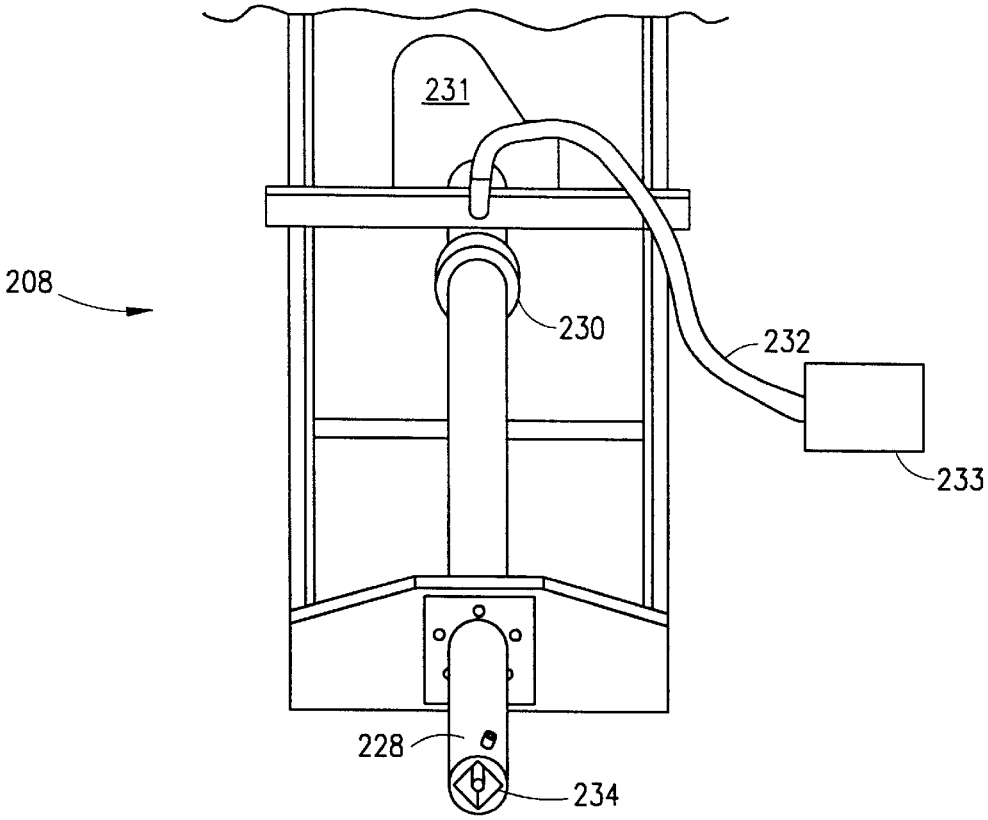
FIG. 5 is a front, perspective view of an auger drill unit used in connection with the mining system of FIG. 2.

As shown in FIGS. 3 through 5, rear end 226 of shaft 220 is removably received within a front end of a quill rod, drill boom, or drill string 228 of drill unit 208. As shown in FIG. 5, drill unit 208 may, in a preferred embodiment, be a Long AIRDOX model auger drill unit. The drill unit consists of a drilling system 231 disposed upon skids having hydraulic lifting jacks, drill boom and carriage. Although not shown in FIG. 5, other conventional auger drill units may be used for drill unit 208. The rear end of drill string 228 is coupled to a high pressure swivel 230, such as that produced by King Oil Tool of Humble, Tex. High pressure swivel 230 is coupled to drilling system 231 of drill unit 208. A high pressure hose 232 is fluidly coupled to a high pressure water source, such as a pumping unit 233, on one end and to a fluid inlet of swivel 230 on a second end. A high pressure hose 234, disposed within drill string 228, is fluidly coupled to a fluid outlet of swivel 230 on a first end and to rear end 226 of shaft 220 on a second end. A high pressure hose 236, disposed within shaft 220, is fluidly coupled to swivel 216 of nozzle head 210 on a first end and to rear end 226 of shaft 220 on a second end. Hoses 232, 234, and 236 preferably having diameters of about 1.0 to 2.5 inches and connected by threaded, snapfit, or other conventional fasteners provide high pressure water from the high pressure water source to nozzles 212 of cutting head 206. Alternatively, hose 232 may provide high pressure water from the high pressure water source, and such water may be communicated to nozzles 212 via swivel 230, drill string 228, shaft 220, nozzle head 210, and tubing 214, if desired. Swivels 216 and 230 allow the rotation of drill string 228, auger body 202, and nozzle head 210 by drilling system 231 of drill unit 208, while preventing the twisting of hoses 232–236.

In an alternative embodiment, it is possible to arrange two auger screws in a side-by-side arrangement and driven by a modified drill unit to cut a generally oval-shaped borehole. In yet another alternative embodiment it is possible to arrange three auger screws in a triangular arrangement and driven by a modified drill unit to cut a generally pie-shaped borehole. These multiple screw embodiments may also comprise a bracket or harness suitable for holding the multiple cutting heads in the proper alignment. It is also understood that each of these screw augers may be sized independently of each other to achieve multiple cutting geometries.

Figure 6:
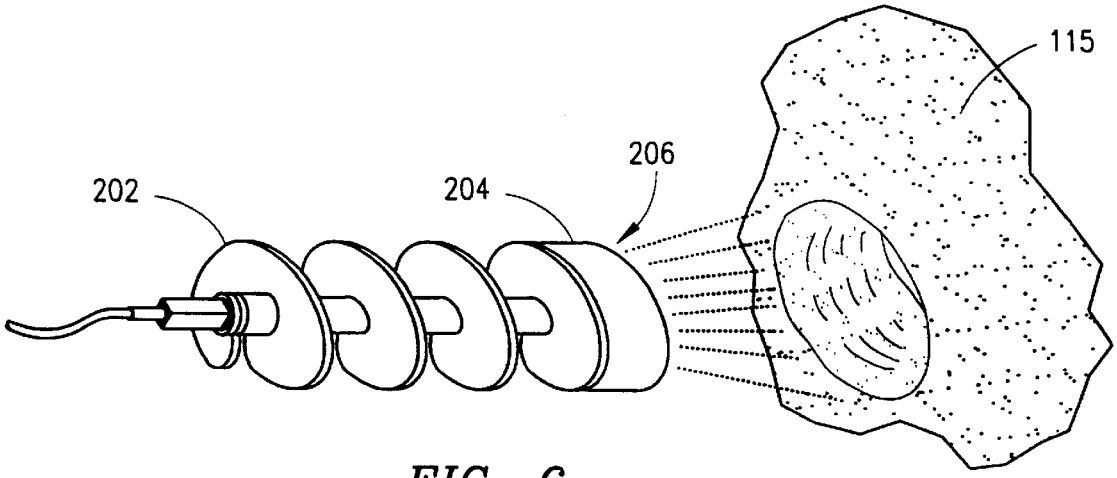
FIG. 6 is a side, perspective view showing the mining system of FIG. 2 in operation.
Figure 7:
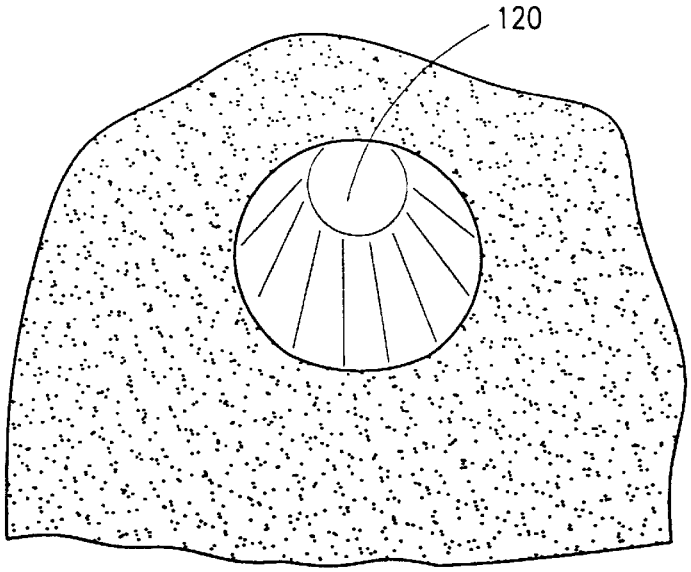
FIG. 7 is a front, perspective view of a borehole made using the mining system of FIG. 2.

Having described the preferred structure of mining system 200, the operation of mining system 200 to mine a relatively thin, generally horizontal coal seam is now described in greater detail in connection with FIGS. 1–7. Referring to FIG. 1, mining system 200, including drill unit 208, is deployed adjacent excavation region 115. Drill unit 208 is positioned at the correct location for drilling a first borehole 120. Drilling system 231 is activated to begin turning auger body 202, and the high pressure water source, not shown, which may include one or more conventional pumps channeled into a single high pressure fluid line is activated to supply high pressure water to nozzles 212 of cutting head 206. The high pressure water source may also comprise an injector for introducing polymers or other additives into the water. As shown in FIG. 6, nozzles 212 create a generally circular pattern of high pressure water on the surface of excavation region 115. As tubing 214 are preferably angled slightly outward, the circular pattern of high pressure water preferably has a diameter slightly greater than the diameter of hollow front end 204 of auger body 202. In a preferred embodiment, the circular pattern of high water pressure defines the outer diameter of borehole 120. Drill unit 208 is then advanced toward excavation region 115 until mechanical bits 215 and 224 began to cut coal. A representative borehole 120 created by mining system 200 is shown in FIG. 7.

As the high pressure water, mechanical bits 215, and mechanical bits 224 cut through excavation region 115, a slurry of water and coal particles drop to the floor of borehole 120. This slurry is carried away from cutting head 206 by helical screw turns 222 of auger body 202. As borehole 120 lengthens, additional sections of auger body, similar to auger body 202 but without a cutting head 206, may be coupled together via pins, threads, snapfit or other conventional connectors at the outby or rear end 226 of shaft 220, as required. In this way, the water and coal slurry continues to be conveyed from cutting head 206 to the head of borehole 120. In addition, drill unit 208 continues to push auger body 202 through borehole 120, keeping cutting head 206 in close proximity to the coal face at the end of borehole 120. Once at the head of borehole 120, the coal is collected and transported using conventional means, such as a belt conveyor. Additional boreholes 120 may be formed in a generally parallel fashion in excavation region 115, and the corresponding coal may be removed, by repeating the above-described process.

Mining system 200 provides significant advantages over conventional hydraulic mining systems and conventional scroll augers. For example, it has been determined that using mining system 200, boreholes 120 may be accurately formed in a generally parallel fashion within excavation region 115 in lengths of up to 500–1000 feet. This increased length represents substantial improvement over the three hundred foot maximum length of boreholes 120 formed using a conventional scroll auger.

In addition, mining system 200 provides improved ability to maintain auger body 202 within a coal seam, as compared to conventional scroll augers. More specifically, as shown best in FIG. 6, the diameter of the circular pattern of high pressure water from nozzles 212 may be used to define the outer diameter of borehole 120. The pressure of the water supplied to nozzles 212 may be controlled so that the high pressure water cuts coal but does not cut rock that forms the floor and ceiling strata of the coal seam. As mechanical bits 215 and 224 are positioned interiorly of the circular pattern of high pressure water formed by nozzles 212, mining system 202 does not cut through floor or ceiling rock strata.

Furthermore, it has been determined that mining system 200 provides significantly higher coal cutting rates as compared to conventional hydraulic or scroll auger mining systems. For example, for a thirty inch diameter borehole 120, a conventional scroll auger typically achieves a penetration rate of approximately 10 feet/minute, which translates into a coal cutting rate of approximately 118 tons/hour. In contrast, for a thirty inch diameter borehole 120, and supplying nozzles 212 with water having a pressure of approximately 3,000 to 10,000 psi, mining system 200 achieves a penetration rate of approximately 20 feet/minute, which translates into a coal cutting rate of approximately 236 tons/hour.

Still further, unlike conventional hydraulic mining systems, mechanical bits 215 and 224 allow mining system 200 to cut through rock strata within the interior of, but not on the floor or ceiling of, borehole 120. In addition, due to the presence of mechanical bits 215 and 224, and auger body 202, mining system 202 requires less water than conventional hydraulic systems. This in turn reduces the amount of, or eliminates the need for, the expensive dewatering processes required by some conventional, hydraulic systems.

The present invention is illustrated herein by example, and various modifications may be made by a person of ordinary skill in the art. For example, numerous geometries, including the geometry of the cutting head, could be altered to accommodate specific applications of the invention.

What is claimed is:

1. A cutting head for creating a borehole in a mineral seam, comprising:

a first body having an axis of rotation generally parallel to said borehole;

a manifold for containing high pressure fluid, said manifold being mounted on said first body;

a high pressure fluid line for providing fluid to said manifold;

a swivel coupled to said high pressure fluid line, said swivel allowing said manifold to rotate relative to said fluid line;

a first plurality of nozzles disposed around said axis of rotation for spraying said high pressure fluid; and a plurality of tubes fluidly coupling said manifold and said plurality of nozzles;

whereby on supplying a high pressure fluid to said manifold and rotating said cutting head about said axis of rotation, said nozzles create a generally circular, overlapping pattern of high pressure fluid in front of said cutting head, said pattern of high pressure fluid being directed to cut said borehole.

2. The cutting head of claim 1 wherein said fluid is water.

3. The cutting head of claim 1 wherein selected ones of said first plurality of nozzles are spaced at different radii from said axis of rotation.

4. The cutting head of claim 1 wherein a first plurality of mechanical bits are disposed in a generally forward orientation on said first body.

5. The cutting head of claim 4 wherein selected ones of said first plurality of mechanical bits are disposed in a generally forward orientation and spaced at different radii from said axis of rotation.

6. The cutting head of claim 4 wherein said pattern of high pressure fluid is directed to cut at a diameter larger than a cutting diameter of said first plurality of mechanical bits.

7. The cutting head of claim 4 further comprising a second body having a generally cylindrical cross-section and said axis of rotation, and wherein said first body is disposed within said second body.

8. The cutting head of claim 7 wherein said first plurality of nozzles are disposed around said axis of rotation between said first body and said second body.

9. The cutting head of claim 7 further comprising a second plurality of mechanical bits disposed around a periphery of said second body.

10. The cutting head of claim 9 wherein:

at least one of said second plurality of mechanical bits is angled inward relative to said axis of rotation; and at least one of said second plurality of mechanical bits is angled outward relative to said axis of rotation.

11. The cutting head of claim 10 wherein said second plurality of mechanical bits are angled, relative to said axis of rotation, in a straight ahead, angled inward, angled outward repeating pattern around said periphery of said second body.

12. The cutting head of claim 9 wherein:

at least a first one of said first plurality of nozzles is disposed proximate said first body;

at least a second one of said first plurality of nozzles is disposed between said first body and said second body; and at least a third one of said first plurality of nozzles is disposed proximate said second body.

13. The cutting head of claim 12 wherein said at least first one of said first plurality of nozzles is angled inward relative to said axis of rotation.

14. The cutting head of claim 13 wherein said at least first one of said first plurality of nozzles is angled inward relative to said axis of rotation at an angle between about zero and about thirty degrees.

15. The cutting head of claim 12 wherein said at least second one and said at least third one of said first plurality of nozzles are angled outward relative to said axis of rotation.

16. The cutting head of claim 15 wherein said at least second one and said at least third one of said first plurality of nozzles are angled outward relative to said axis of rotation at an angle between about zero and about thirty degrees.

17. The cutting head of claim 9 wherein said pattern of high pressure fluid is directed to cut at a diameter larger than a cutting diameter of said second plurality of mechanical bits.

18. The cutting head of claim 9 further comprising a second plurality of nozzles disposed in a generally forward orientation and proximate a periphery of said second body.

19. The cutting head of claim 18 wherein at least a first one of said second plurality of nozzles is angled outward relative to said axis of rotation.

20. The cutting head of claim 19 wherein said at least first one of said second plurality of nozzles is angled outward relative to said axis of rotation at an angle of less than about 30 degrees.

21. The cutting head of claim 18 wherein at least a second one of said second plurality of nozzles is angled inward relative to said axis of rotation.

22. The cutting head of claim 8 wherein said first body has a generally cylindrical cross-section, and said first plurality of mechanical bits are disposed around a periphery of said first body.

23. The cutting head of claim 7 wherein:

at least one of said first plurality of mechanical bits is angled inward relative to said axis of rotation; and at least one of said first plurality of mechanical bits is angled outward relative to said axis of rotation.

24. The cutting head of claim 23 wherein said first plurality of mechanical bits are angled, relative to said axis of rotation, in an angled inward, angled outward repeating pattern around said periphery of said first body.

25. The cutting head of claim 7 wherein said pattern of high pressure fluid is directed to cut across substantially an entire face of said cutting head.

26. The cutting head of claim 7 wherein said first plurality of nozzles are spaced at different radii from said axis of rotation.

27. The cutting head of claim 7 wherein said mechanical bits are spaced a different radii from said axis or rotation.

28. The cutting head of claim 7 wherein said first plurality of nozzles are disposed in a generally coplanar, circular arrangement about said axis of rotation.

29. The cutting head of claim 1 further comprising a second body having a generally cylindrical cross-section and said axis of rotation, and wherein said first body is disposed within said second body.

30. A mining system for creating a borehole in a mineral seam, comprising:

a cutting head comprising:

a first body having an axis of rotation generally parallel to said borehole;

a manifold for containing high pressure fluid, said manifold being mounted on said first body;

a high pressure fluid line for providing fluid to said manifold;

a swivel coupled to said high pressure fluid line, said swivel allowing said manifold to rotate relative to said fluid line;

a first plurality of nozzles disposed around said axis of rotation for spraying said high pressure fluid; and a plurality of tubes fluidly coupling said manifold and said plurality of nozzles;

whereby on supplying high pressure fluid to said manifold and rotating said cutting head about said axis of rotation, said nozzles create a generally circular, overlapping pattern of high pressure fluid in front of said cutting head, said pattern of high pressure fluid being directed to cut said borehole;

at least one auger body attached to the trailing end of said cutting head;

a drill unit coupled to said at least one auger body and capable of imparting rotational and thrusting forces to the at least one auger body and the attached cutting head; and a pumping unit for providing high pressure fluid via said swivel and said high pressure fluid line to the manifold and the nozzles of said cutting head.

31. The mining system of claim 30 wherein said high pressure fluid is water.

32. The mining system of claim 30 wherein said high pressure fluid line delivers fluid to said manifold of said cutting head via a hollow shaft through said at least one auger body.

33. The mining system of claim 30 wherein said pumping unit further comprises at least one pump and a pump manifold for directing high pressure fluid from said at least one pump into said high pressure fluid line.

34. The mining system of claim 30 wherein said cutting head further comprises a first plurality of mechanical bits disposed on said first body.

35. The mining system of claim 34 wherein said cutting head further comprises a second body having a generally cylindrical cross-section and said axis of rotation, and wherein said first body is disposed within said second body.

36. The mining system of claim 35 wherein said cutting head further comprises a second plurality of mechanical bits disposed around a periphery of said second body.

37. The mining system of claim 35 wherein said cutting head further comprises a second plurality of nozzles disposed in a generally forward orientation and proximate a periphery of said second body.

38. The mining system of claim 30 wherein said cutting head further comprises a second body having a generally cylindrical cross-section and said axis of rotation, and wherein said first body is disposed within said second body.

39. A method of creating a borehole in a mineral seam, comprising the steps of:

providing a cutting head having:

a manifold for containing high pressure fluid;

an axis of rotation generally parallel to said borehole;

and a plurality of nozzles disposed at various radii around said axis of rotation for spraying said high pressure fluid;

positioning said cutting head proximate a mineral seam;

supplying said high pressure fluid to said manifold;

rotating said cutting head about said axis of rotation to create a generally circular, overlapping pattern of high pressure fluid in front of said cutting head; and cutting said borehole with rotating pattern of high pressure fluid.

40. The method of claim 39 wherein said supplying step comprises supplying high pressure water to said manifold.

41. The method of claim 39 wherein said cutting head further comprises a plurality of mechanical bits.

42. The method of claim 41 wherein said rotating step creates said pattern of high pressure fluid with a diameter larger that a cutting diameter of said plurality of mechanical bits.

43. The method of claim 39 wherein said rotating step creates said pattern of high pressure fluid across substantially an entire face of said cutting head.

44. The method of claim 39 wherein said rotating step comprises:

providing an auger body;

coupling said auger body to said cutting head;

coupling said auger body to a drill unit disposed remote from said cutting head; and rotating said cutting head and said auger body with said drill unit.

45. The method of claim 44 wherein said supplying step comprises supplying high pressure fluid to said manifold via a hollow shaft of said auger body.

46. The method of claim 44 wherein said rotating step moves cut material away from said cutting head using said auger body.

47. The method of claim 39 further comprising the step of removing cut material away from said cutting head.

48. The method of claim 39 wherein said mineral seam is a relatively thin, generally horizontal mineral seam.

* * * * *

UNITED STATES PATENT AND TRADEMARK OFFICE

CERTIFICATE OF CORRECTION

PATENT NO. : 6,293,628 B1
DATED : September 25, 2001
INVENTOR(S) : Jeffrey J. Schwoebel et al.

It is certified that error appears in the above-identified patent and that said Letters Patent is hereby corrected as shown below:

Column 1,
Line 58, replace "in by" with -- inby --

Signed and Sealed this

Twentieth Day of August, 2002

*Attest:*

*Attesting Officer*

JAMES E. ROGAN
*Director of the United States Patent and Trademark Office*